US006074121A

United States Patent [19]

Medeiros et al.

[11] Patent Number: 6,074,121

[45] Date of Patent: Jun. 13, 2000

[54] FASTENING LUG

[75] Inventors: Jay C. Medeiros, Collierville; Gregory C. Marik, Germantown, both of Tenn.; James E. Boettcher, Whitehouse Station; Harry C. Mathis, Clark, both of N.J.

[73] Assignee: Thomas & Betts Corporation, Memphis, Tenn.

[21] Appl. No.: 08/886,213

[22] Filed: Jun. 30, 1997

[51] Int. Cl.[7] ..... H04R 4/36

[52] U.S. Cl. ..... 403/362; 403/41; 403/12; 439/810; 439/812

[58] Field of Search ..... 403/362, 41, 11, 403/12; 411/393; 439/810, 814, 811, 812

[56] References Cited

U.S. PATENT DOCUMENTS

| | | | |
|---|---|---|---|
| 2,161,249 | 6/1939 | Dibner | 439/812 |
| 2,907,978 | 10/1959 | Bergan | 439/811 |
| 4,213,669 | 7/1980 | Wittes et al. | 439/811 |
| 4,806,108 | 2/1989 | Meinhardt . | |
| 4,875,864 | 10/1989 | Campbell . | |
| 5,197,907 | 3/1993 | Hurtgen | 439/810 |

FOREIGN PATENT DOCUMENTS

| | | | |
|---|---|---|---|
| 245508 | 11/1946 | Germany | 439/812 |
| 1227969 | 11/1966 | Germany | 439/811 |
| 1268162 | 3/1972 | United Kingdom | 439/812 |
| 1295391 | 11/1992 | United Kingdom | 439/810 |

*Primary Examiner*—Lynne H. Browne
*Assistant Examiner*—David E. Bochna
*Attorney, Agent, or Firm*—Hoffmann & Baron, LLP

[57] ABSTRACT

A vibration-tolerant torque limiting fastening lug whereupon tightening of the set-screw produces a parasitic torque at the thread plane defining the set-screw/housing interface. The resultant parasitic torque acts in opposite direction to the installation torque such that the actual torque below the thread plane is less than the installation torque. As a result, the tensile force experienced by the set-screw and which acts against the housing of the lug is reduced.

10 Claims, 17 Drawing Sheets

BEGINNING FAILURE $\delta Y$ = .037 in.

OVERLOADED $\delta Y$ = .029 in.
$F_T$ = 375 lb.
$F_S$ = 95 lb.

DESTRUCTION $\delta_Y$ = .043 in.

FIG-10 LUG FASTENER PRELOAD ANALYSIS
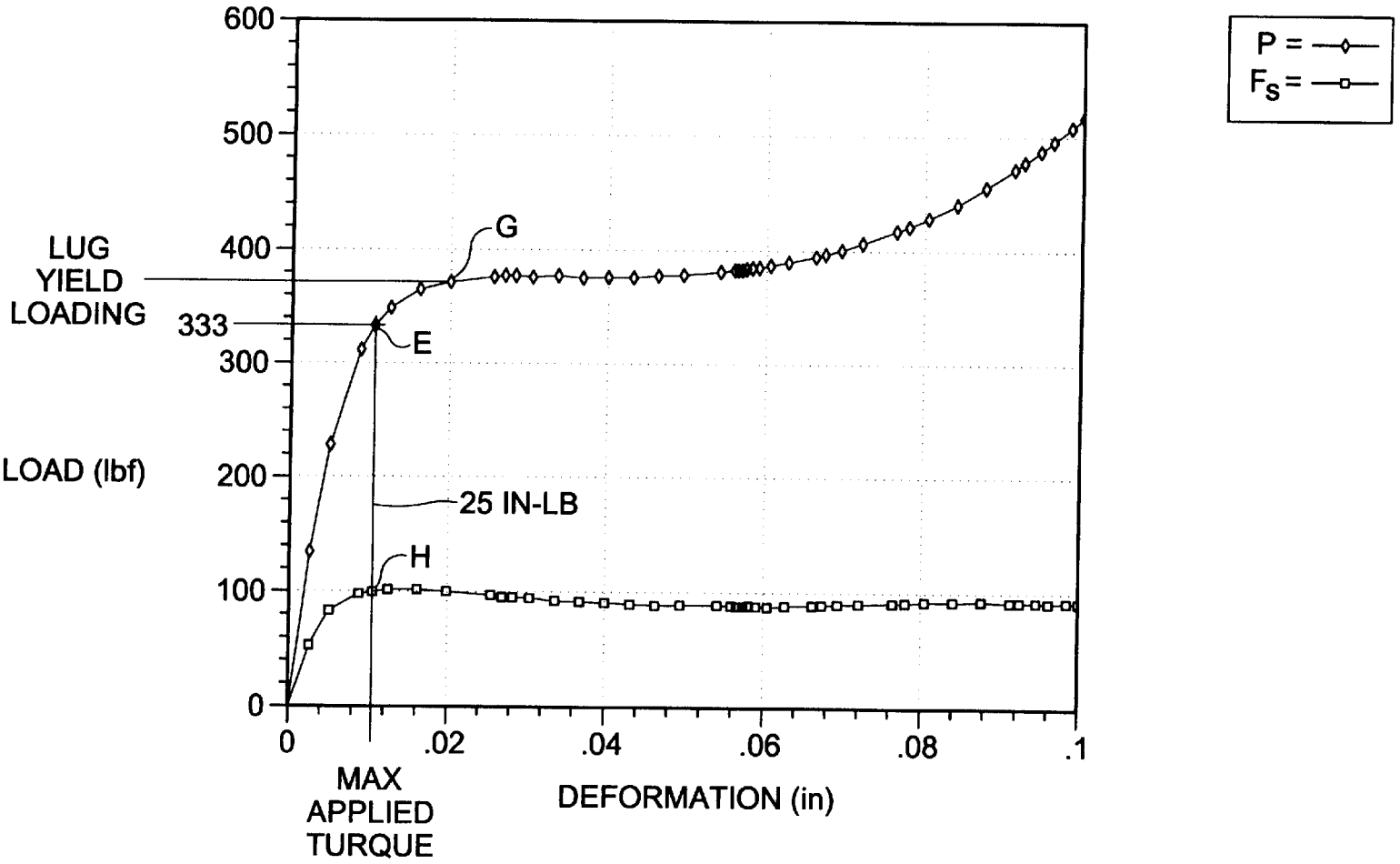

FASTENING LUG

BACKGROUND OF THE INVENTION

The present invention relates to an improved fastening lug and, more particularly, to a vibration tolerant, torque-limiting lug exhibiting increased thread strength.

Fastening lugs are used in several applications. One well known application is the use of a lug to both mechanically fix and electrically couple a grounding wire to a metal structure. The lugs used for such an application are often referred to as "grounding lugs." One commonly encountered commercial application involves the installation of a grounding conductor (pursuant to electrical code) between fittings used to terminate and/or couple non-metallic conduit. In the aforementioned application, the grounding lug itself is mechanically coupled to a portion of the fitting, e.g., the gland nut of the fitting.

With respect to fastening lugs and, more particularly grounding lugs, it will be recognized by those skilled in the art that it is a common design goal to reduce the amount of material used to form the lug. Inasmuch as the cost of material represents a substantial portion of the total cost of the lug, a reduction in the amount of material used to form the component can produce significant cost savings. However, it will be also recognized that a reduction in the wall thickness of the stock material used to form the lug will significantly decrease the strength of the structure, thus rendering such structure prone to failure from deformation of the lug and/or to thread failure from overtightening of the set-screw.

An additional problem encountered with fastening lugs and, particularly grounding lugs, concerns the tendency of the fastener (e.g., the set-screw) to "back-out" of the threaded opening formed in the housing of the lug during shipping/handling of the lug. Specifically, vibration encountered during shipping/handling of the fastening lugs is often sufficient to produce the aforementioned back-out, causing the set-screw to disassemble from the housing of the lug. This disassembly is both bothersome and time consuming to the installer. Prior art techniques such as "staking" of the set screw address the problem of back-out, but are relatively costly. Other techniques such as tightening the set-screw prior to shipping require the installer to first perform the time consuming step of untightening the set-screw before insertion of the grounding conductor.

There is therefore a need in the art for a fastening lug which allows the fabrication of such lug from thinner walled stock material, but which provides a structure which resists deformation failure due to overtightening of the set-screw. There is a further need in the art for a fastening lug which includes a threaded passage of increased length and increased thread strength, and which allows use of larger diameter set screw. Finally, there is a need in the art for a fastening lug which allows shipping and handling of the lug without back-out of the set-screw and without staking and/or requiring complete tightening of the set-screw.

SUMMARY OF THE INVENTION

The present invention, which addresses the needs of the prior art, relates to a torque-limiting threadform. The threadform includes a fastener joint and a cooperating fastener. The fastener cooperates with the fastener joint along an engagement plane and is movable between a first untightened position and a second tightened position. The fastener is configured to introduce a stress into the fastener joint when the fastener is moved to the second tightened position.

The fastener joint is configured to allow the stress to produce transverse shear forces along the engagement plane which acts against the fastener. The shear forces develop a parasitic torque opposite in direction to an installation torque wherein the relationship of forces is defined by the equation:

$$T=kDP-S \text{ wherein}$$

T=installation torque;

k=nut friction factor (0.08 to 1.0);

D=bolt mean diameter;

P=tensile preload force; and

S=the parasitic torque due to thread shear and S=f(T).

The present invention further relates to a method of limiting the torque applied to a housing of a fastening lug. The method includes the step of providing a fastening lug including a cooperating fastener. The fastener is movable between a first untightened position and a second tightened position. The fastener is sized to impart a stress into the fastening lug upon movement of the fastener to the second position. The fastening lug is sized to transfer the stress to an engagement plane defining an interface between the fastening lug and the fastener. The method includes the additional step of tightening of the fastener with respect to the fastening lug by application of an installation torque thereto whereby a stress is introduced into the fastening lug creating transverse shear forces at the engagement plane which acts against the fastener thus producing a parasitic torque counteractive to the installation torque whereby the torque experienced by the fastening lug is less than the installation torque.

The present invention additionally relates to a fastening lug. The lug includes a housing defined by at least top, bottom and side walls. The lug further includes a fastener cooperating with the top wall and advancable between a first position wherein a portion of a body is positioned in the housing and a second position wherein the portion is pressed between the bottom wall and the fastener whereby the portion is retained within the housing. The top wall includes upper and lower legs. The upper leg is integrally formed with one of the side walls and the lower leg is integrally formed with the other of the side walls. One of the legs includes an extruded threaded collar located on a surface thereof such that the collar is subjected to compressive forces when the fastener is advanced to said second position.

The present invention further relates to a method of forming a lug. The method includes the step of providing a strip of material. The method includes the additional step of piercing a first hole through a first side of said strip and a second hole through a second side of the strip. The method includes the further step of extruding each of the holes to form first and second collars positioned on the first and second sides of the strip, respectively. The method also includes the step of threading each of the collars. Finally, the method includes the step of forming the housing. In turn, the forming step includes the step of bending the strip to substantially align the collars to allow a set-screw to be threadingly engaged with both of the threaded collars.

The present invention also relates to a vibration-tolerant fastening lug assembly. The assembly includes a housing defined by at least top, bottom and side walls. The assembly further includes a fastener cooperating with the top wall and advancable between a first position wherein a portion of a body is positioned in the housing and a second position wherein the portion is pressed between the bottom wall and the fastener whereby the portion is retained within the housing. The top wall includes two legs, one of the legs being associated with one of the side walls and the other of the legs being associated with the other of the side walls. Each of the legs has a threaded passage therethrough to allow advancement of the fastener into the housing. The passages are axially misaligned whereby alignment of the passage for insertion of the fastener imparts vibration-resistant shear forces on the fastener along the threaded passages which resist back-out of the fastener when the housing is subjected to vibration.

As a result, the present invention provides a fastening lug which allows the fabrication of such lug from thinner walled stock material, but which provides a structure which resists deformation failure due to overtightening of the set-screw. The present invention further provides a fastening lug which includes a threaded passage of increased length and increased thread strength, and which allows use of larger diameter set screw. Finally, the present invention provides a fastening lug which allows shipping and handling of the lug without back-out of the set-screw and without staking and/or requiring complete tightening of the set-screw.

BRIEF DESCRIPTION OF THE DRAWINGS

FIG. 10 is a graphical representation of load v. deformation experienced by the grounding lug analyzed in FIGS. 9*a*–9*f;*

DETAILED DESCRIPTION OF THE INVENTION

As will be recognized by those skilled in the art, fastening lugs are used in a variety of applications wherein a portion of a body is secured within the enclosure defined by such lug. The body is preferably secured within the lug through mechanical interaction of the body and a fastener cooperating with at least one wall of the lug. In one well known application, a lug is used to both mechanically secure and electrically couple a grounding wire therein. In turn, the lug is mechanically and electrically coupled to a metal fixture, e.g., a fitting used to terminate a section of conduit. In another application, a lug is used with a hose clamp to secure the tail end of the hose clamp once such clamp has been sufficiently tightened about a tubular member. Of course, fastening lugs are used in other well known applications. Thus, the following description, although directed to the fastening lugs utilized to ground wire conductors (commonly referred to as "grounding lugs"), is not intended to be limited to grounding lugs, but to encompass all such fastening lugs which define at least a partially enclosed housing having at least one advanceable fastener, e.g., a set screw, which cooperates with the housing to frictionally retain a portion of a body (moveable with respect to the housing) therein.

One commonly encountered application for grounding lugs is associated with the use of liquidtight flexible metal conduit. In this regard, various electrical codes require the installation of a secondary grounding conductor between fittings on opposing ends of a length of conduit. For example, the NEC (National Electrical Code) requires such a secondary grounding conductor on any run of flexible metallic liquidtight metal conduit in excess of six feet. Thus, a secondary grounding conductor would be installed (and thus stretch between) the fittings installed on opposing ends of the length of conduit.

Figure 1:
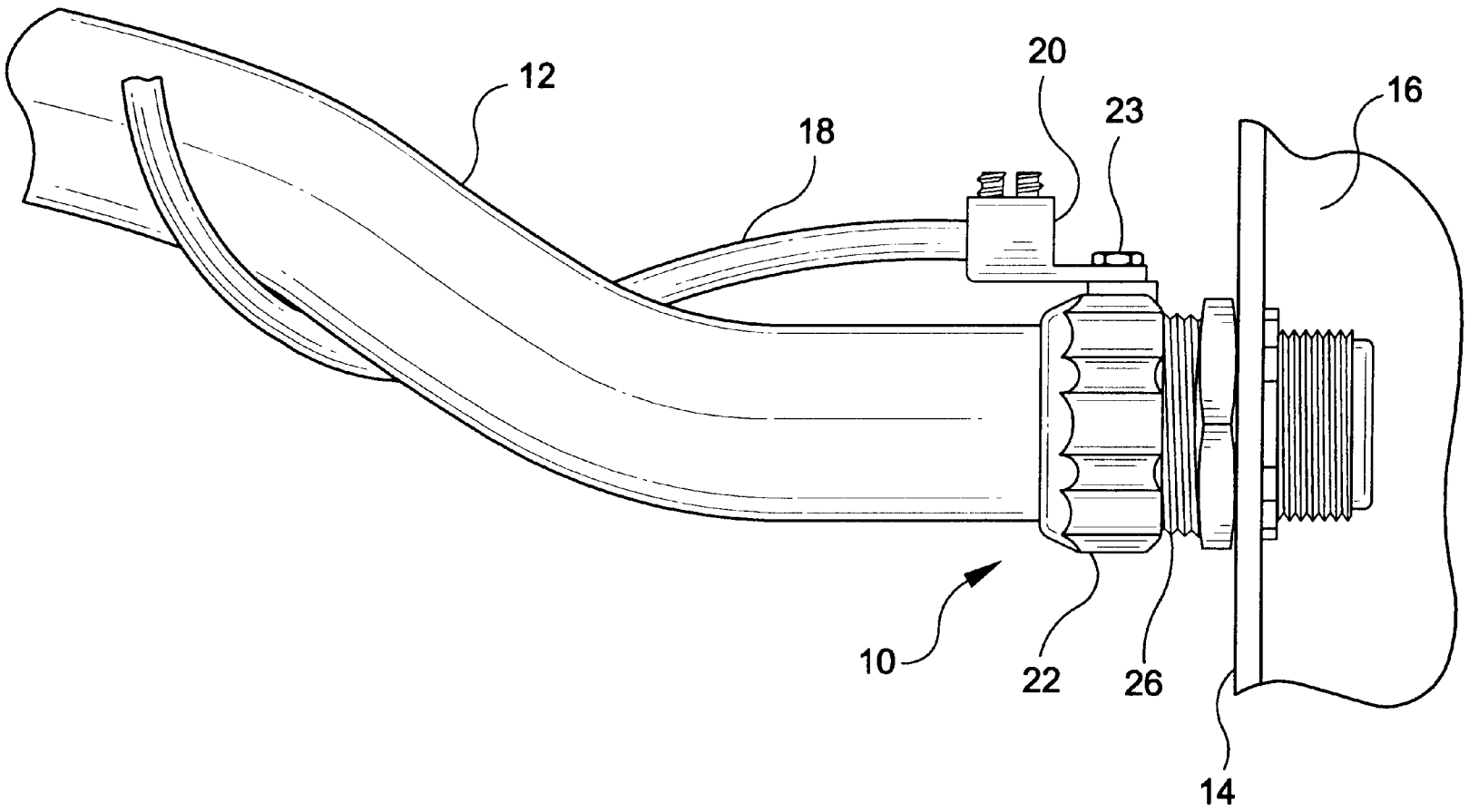
FIG. 1 is a view of a section of liquidtight flexible metal conduit terminating at a wall of an enclosure wherein a grounding lug is attached to a gland nut of a fitting.

Referring to FIG. 1, a liquidtight flexible metal conduit fitting 10 is shown terminating an end extent of a flexible metal conduit 12 to a wall 14 of an enclosure 16. As shown, grounding conductor 18 is secured within a grounding lug 20 attached to a gland nut 22 of fitting 10. Grounding lug 20 is attached to gland nut 22 via screw 23. A second fitting (not shown), similar to fitting 10, would be used to terminate the opposing end of conduit 12 (not shown) in similar fashion. A second grounding lug would be attached to the gland nut on this second fitting, and grounding conductor 18 would therefore stretch between the two grounding lugs. As a result, the opposing fittings would be electrically connected to one another at a ground or zero potential. Grounding conductor 18 is often referred to as an external bonding jumper.

Figure 2:
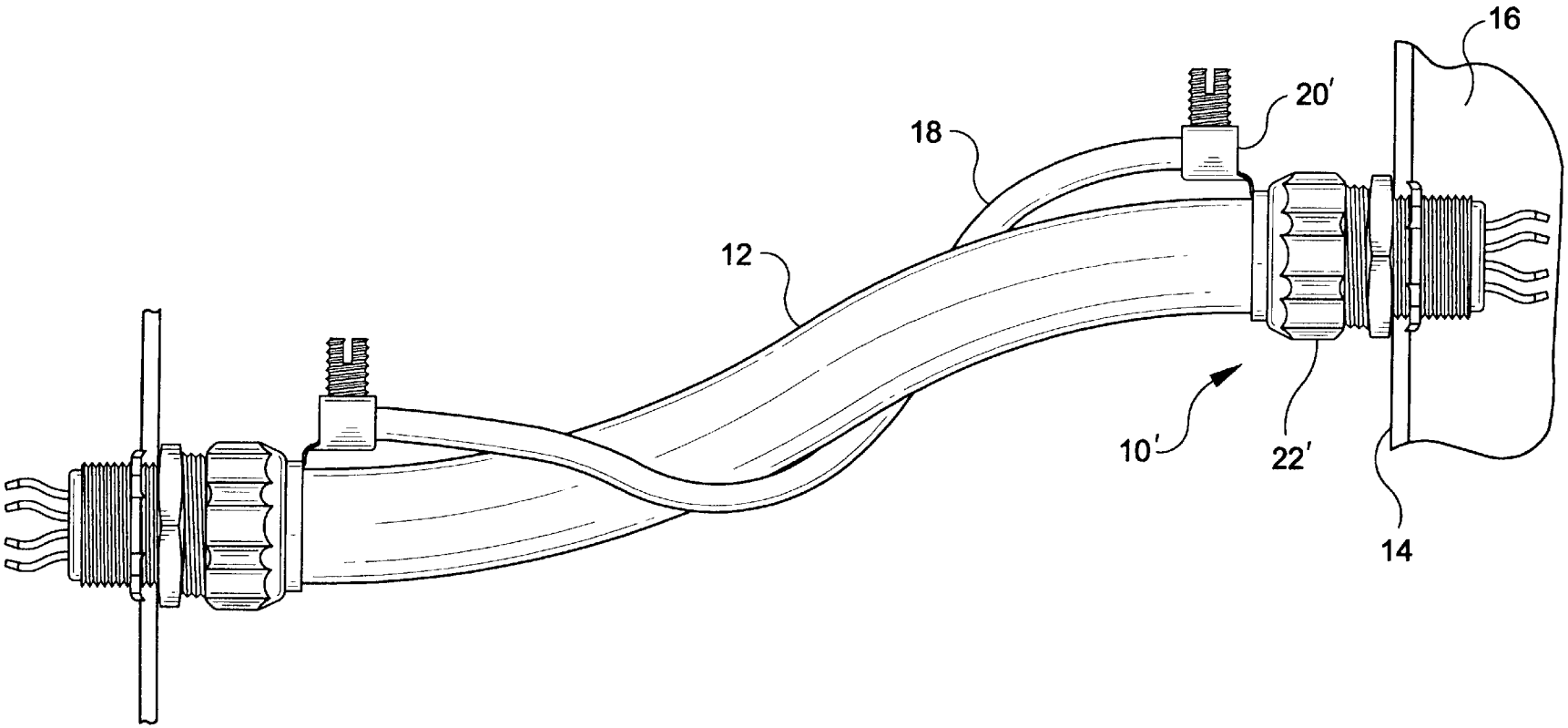
FIG. 2 is a view similar to FIG. 1 wherein an alternative grounding lug is coupled to the gland nut of the fitting.

In one preferred embodiment, as shown in FIG. 2, the grounding lug, i.e., lug 20' includes an integrally formed arm and support base which allows such assembly to cooperate with gland nut 22' of fitting 10' in a rotationally unrestrained manner whereby the grounding lug may be located at a suitable angular position prior to tightening of the gland nut to the fitting. A further description of the rotationally unrestrained cooperation of the fastening lug assembly and gland nut shown in FIG. 2 is set forth in commonly owned copending U.S. application Ser. No. 08/835,399 filed Apr. 7, 1997, incorporated herein by reference.

Figure 3:
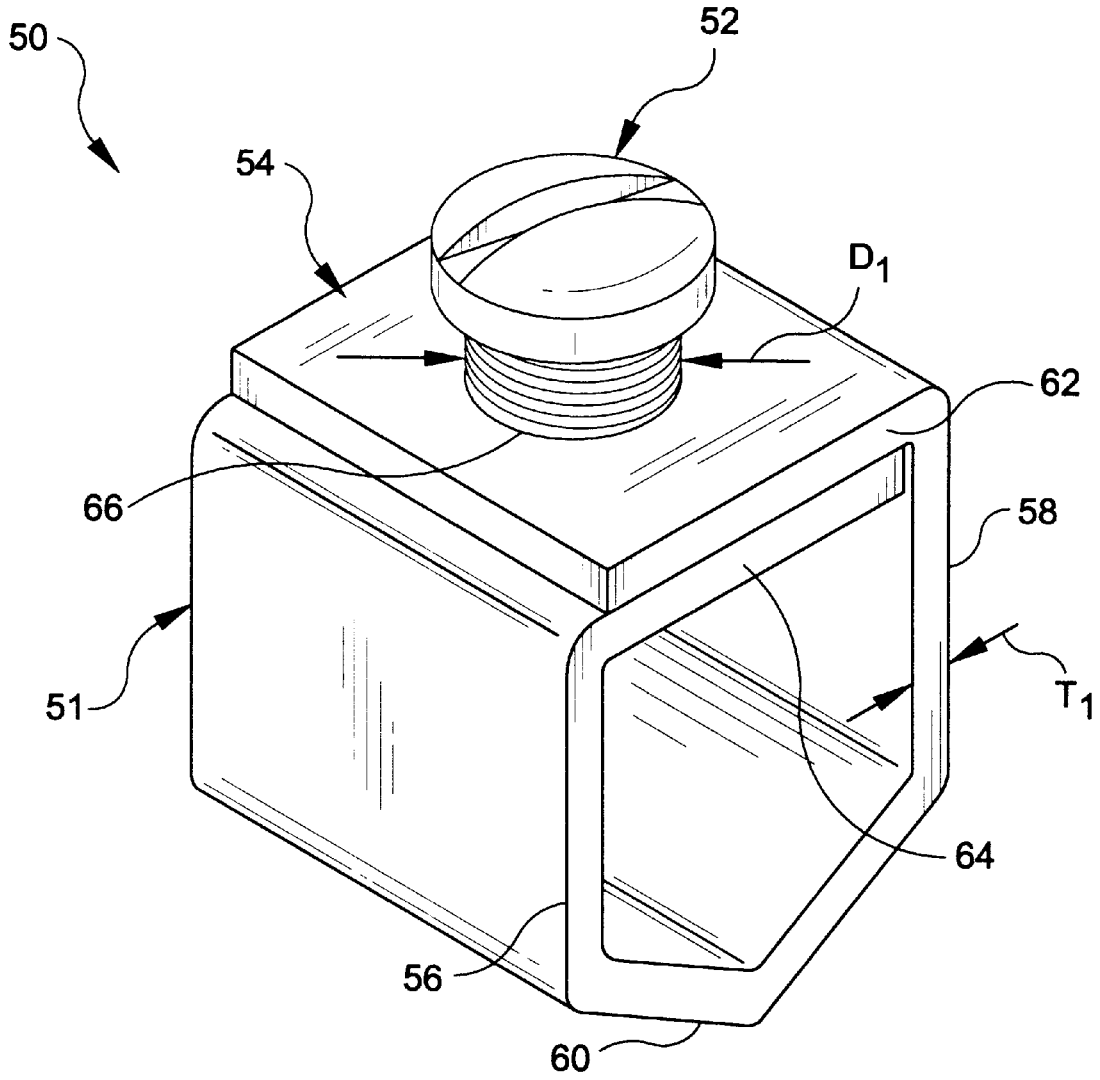
FIG-3 PRIOR ART
FIG. 3 is a perspective view of a prior art grounding lug.

A typical prior art grounding lug, i.e. lug 50, is shown in FIG. 3. Lug 50 includes a housing 51 and a set screw 52 having a diameter $D_1$. The lug includes top wall 54, side walls 56, 58, and bottom wall 60. Top wall 54, which is defined by a double material thickness, includes upper leg 62 (attached to side wall 58) and lower leg 64 (attached to side wall 56). The wall thickness of the material, i.e. $T_1$, is constant throughout the lug. $T_1$ is of sufficient size as to resist any deformation of the structure during clamping of the wire conductor therein. In one known prior art grounding lug, $T_1$ is formed from tin-plated brass and is on the order of 0.080 inches. In certain prior art lugs, the upper and lower legs of the top wall may be secured to one another, e.g., by spot welding. Finally, the prior art lug of FIG. 3 may include a saddle (not shown) at the end of screw 52 to facilitate clamping of the wire conductor within the housing.

To couple screw 52 to the grounding lug, a threaded passage 66 is formed in both upper leg 62 and lower leg 64 of lug 50. As will be recognized, each leg has a section of threads having a length equal to the thickness of the material, i.e. a length $T_1$. Stated differently, screw 52 cooperates with two sets of threads each having a length $T_1$ for a total length of 0.160 inches.

Figure 4:
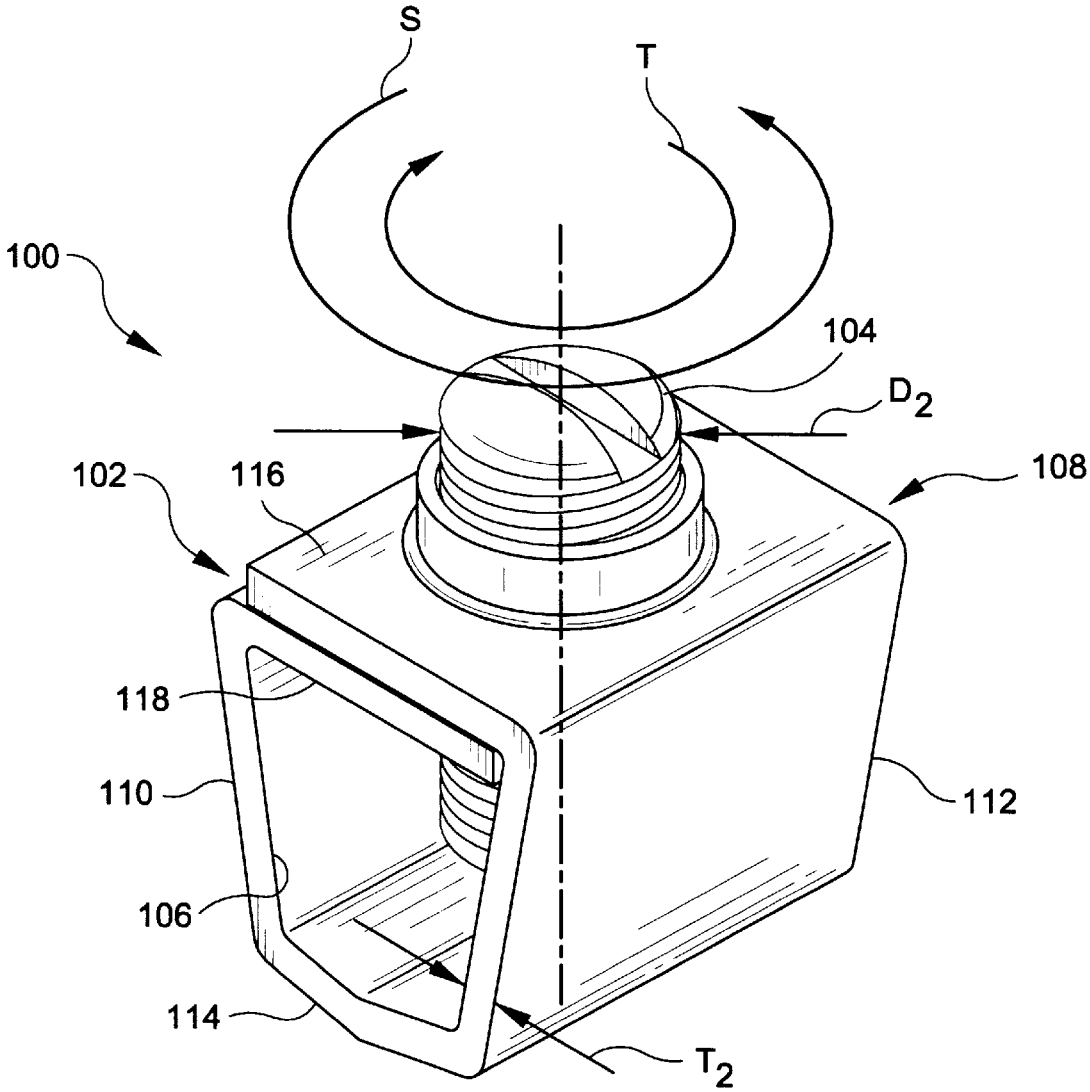
FIG. 4 is a perspective view of the grounding lug of the present invention.

A fastening lug formed in accordance with the present invention is shown in FIG. 4. Lug 100 includes a housing 102 and a set screw 104. The housing defines an enclosure 106 sized to allow insertion and capture of a body, e.g., a grounding conductor, therein. Housing 102 includes top wall 108, side walls 110,112 and bottom wall 114. As shown, top wall 108 is formed from upper leg 116 (integrally formed with side wall 112) and the lower leg 118 (integrally formed with side wall 110). As a result, top wall 108 defines a double wall thickness. The wall thickness $T_2$ in one preferred embodiment is approximately 0.040 inches.

Screw 104 preferably has a diameter $D_2$, wherein $D_2$ is greater than $D_1$, and in one preferred embodiment is 0.25". The use of a larger diameter screw eliminates the need for a saddle in many applications. Moreover, the larger sized screw allows the use of a headless screw, in contrast to the screw associated with prior art lug 50. Both of these features reduce the cost of the fastening lug. Finally, a larger diameter set-screw provides increased thread cross-sectional area, which resists stripping of the threads due to loading of the screw.

However, it will also be recognized that the use of a larger sized set-screw would appear incompatible with lug designs wherein the wall thickness of the lug housing has been minimized to reduce costs. The use of larger sized set-screws generally requires the testing of the component at higher installation torques pursuant to certain electrical codes. As discussed hereinbelow, the application of a higher installation torque produces a higher tensile force in the screw, which is resisted by the housing of the lug. A larger tensile force in a fastening lug of thinner-walled material would be expected to result in the deformation of such lug to an unacceptably large degree and/or to result in the screw stripping the threads.

Figure 5A:
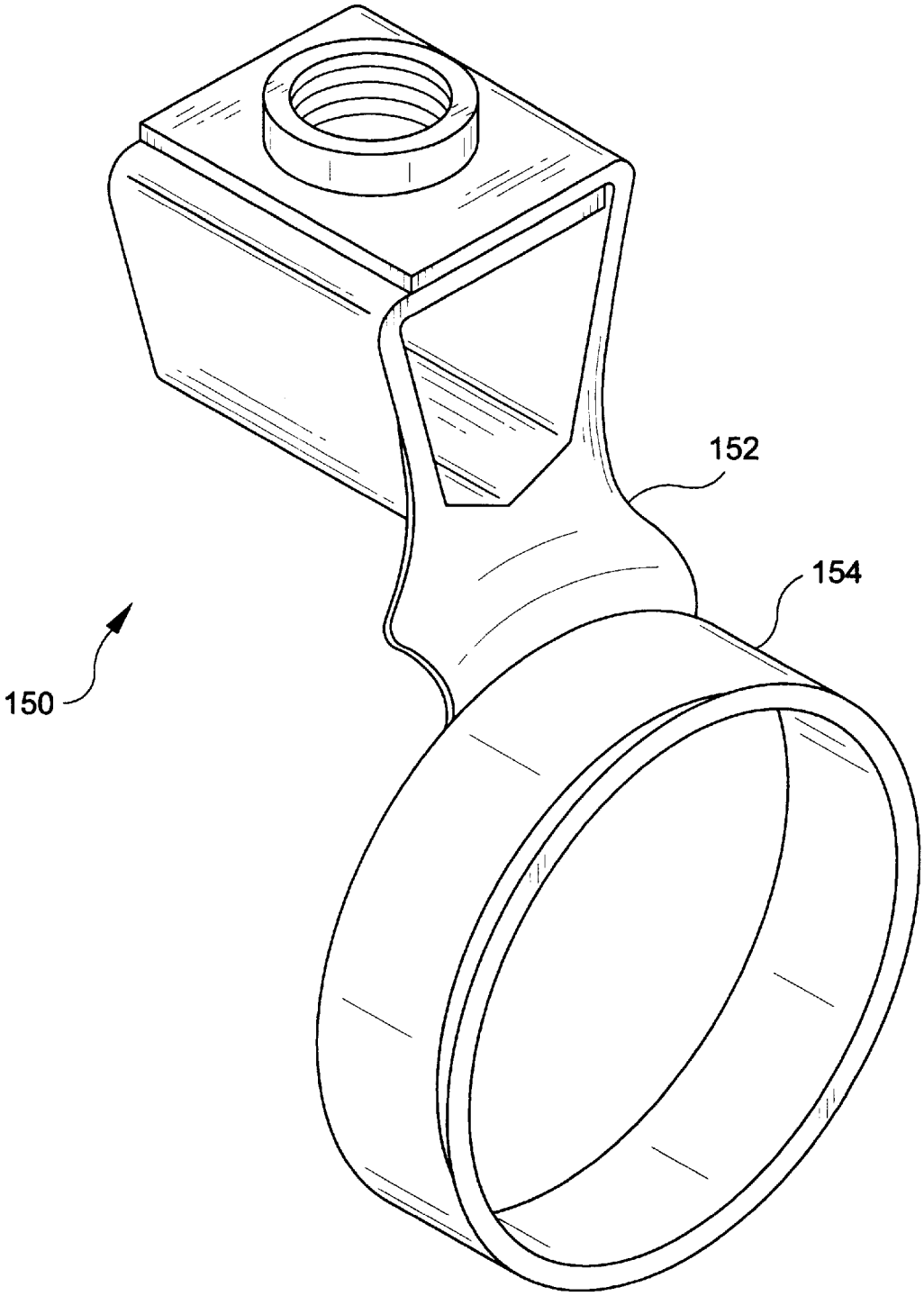
FIG. 5*a* is a perspective view of an alternative embodiment of the grounding lug of the present invention.
Figure 5B:
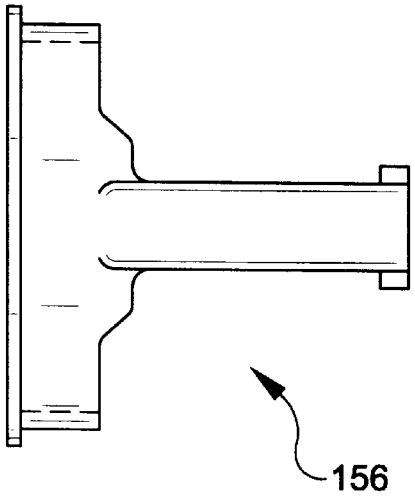
FIGS. 5*b*–5*c* are views of a base/arm member which may be used in connection with the grounding lug of FIG. 4.
Figure 5C:
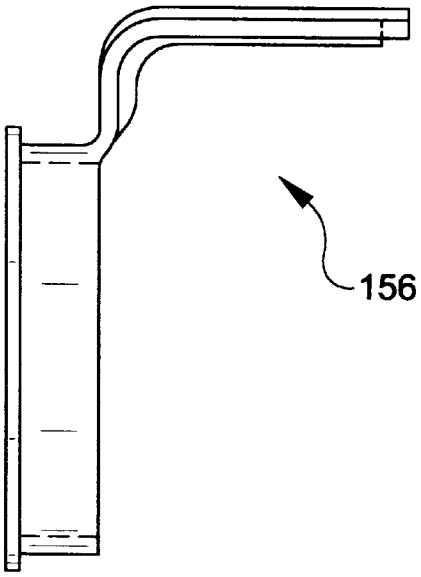

As shown in FIG. 5*a*, in one preferred embodiment, the lug, i.e., lug 150, includes an integrally formed arm 152 and a support base 154 sized to cooperate with a gland nut of a fitting (not shown). Alternatively, the lug of the present invention may cooperate with a base/arm member 156 (see FIGS. 5*b*–5*c*) which is separately formed from the lug. The cooperation of support base 154 and/or member 156 with the gland nut is described in further detail in commonly-owned copending U.S. patent application Ser. No. 08/835,399 filed Apr. 7, 1997. The lug of the present invention may also include a shoulder which is adapted to attach to an external location on a gland nut, as shown in FIG. 1.

Fastening lugs are commonly shipped and/or handled with the set screw threadably engaged with the threaded passage of the housing. During this shipping/handling, vibration imparted on the fastening lug can cause the set screw to "back-out" and thus disassemble from the lug housing. This disassembling is both inconvenient and time consuming to the installer. One prior art method of preventing backing out of the set screw during handling/shipping requires the set-screw to be fully inserted and thereafter tightened against the housing of the lug. Although this tightening of the screw against the housing of the lug prevents back-out of the screw during shipping/handling, it requires the installer to perform the additional step of first backing the screw out a sufficient distance before the wire conductor may be inserted into the housing. This additional step is also inconvenient and/or time consuming to the installer. Alternatively, the set screw may be "staked" to prevent back-out of the screw during shipping/handling. However, staking of the screw involves an additional manufacturing process, thus increasing the cost of the assembly.

Figure 6A:
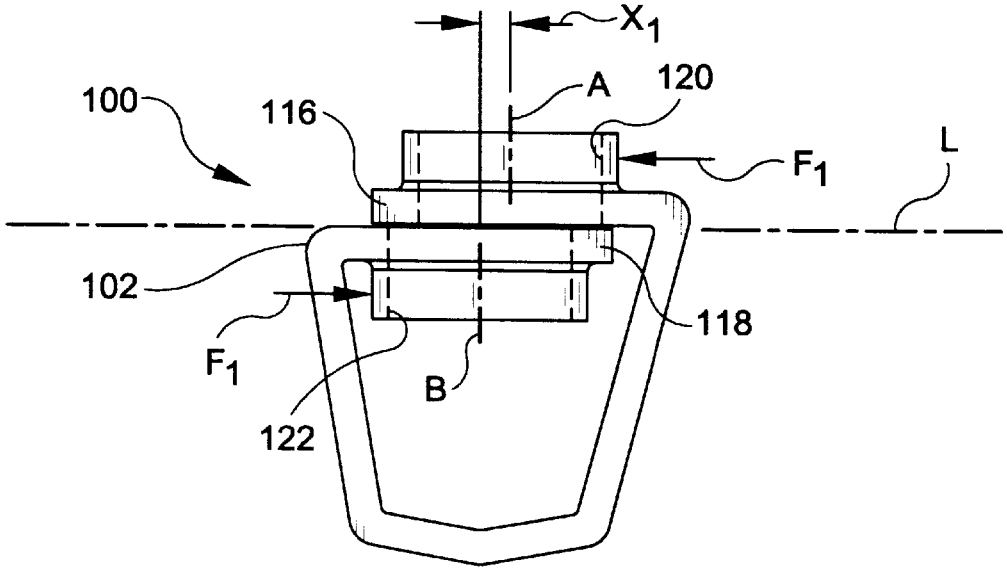
FIGS. 6*a*–6*b* are elevational views of the grounding lug of the present invention depicting the vibration-tolerant feature of the present invention.
Figure 6B:
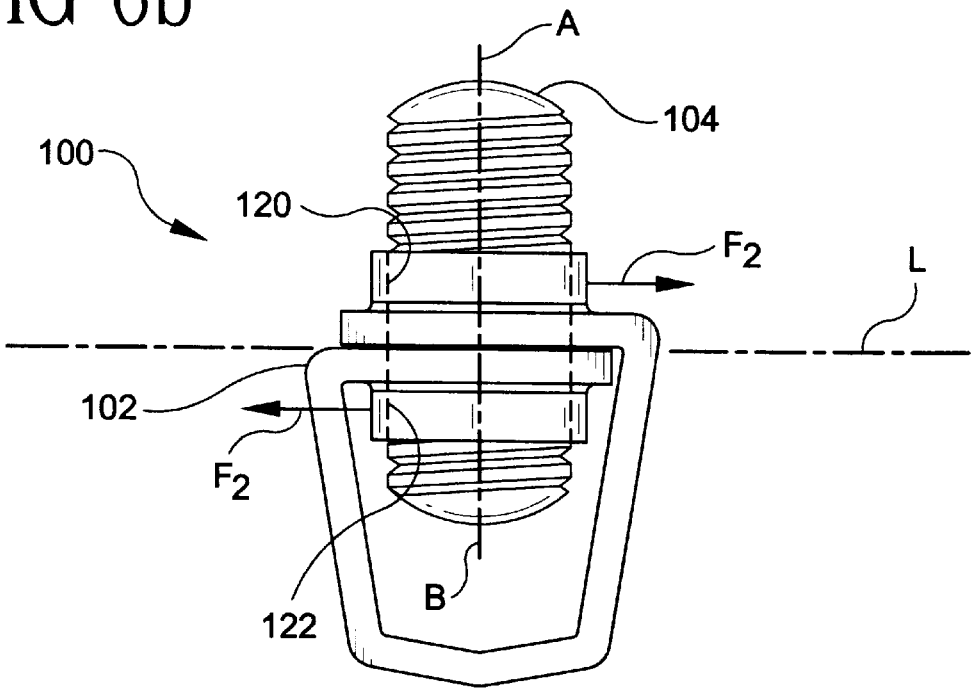

In this regard, one aspect of the present invention is directed to a vibration tolerant fastening lug having a captured fastener. Referring to FIG. 6*a*, fastening lug 100 is formed so that axis A of passage 120 is misaligned with axis B of passage 122 a distance $X_1$. To threadably couple the set-screw 104 to the housing 102, the housing must be compressed a distance $X_1$ along thread plane L by application of a horizontal force $F_1$ to legs 116 and 118. Thread plane L is defined as a plane contacting both the lower surface of upper leg 116 and the upper surface of lower leg 118. Once the screw is threadably inserted through both passages 120 and 122 as shown in FIG. 6*b*, the screw itself maintains the alignment of axes A and B. As a result, a pair of opposing shear forces $F_2$ (equal to $F_1$ but opposite in direction) are imparted on the screw by the housing. More particularly, the memory of the material forming the housing urges the housing to return to its original state, i.e., the state wherein passages 120 and 122 are misaligned. As a result, this urging by the housing imparts shear forces $F_2$ on the screw which prevent the set-screw from back-out from the threaded passages of the housing due to vibration experienced during shipping/handling.

As will be appreciated by those skilled in the art, the reduction in the amount of material used to manufacture a component (such as a grounding lug) can result in significant cost savings. Material reduction may be accomplished through use of materials having a thinner wall thickness. However, decreasing the wall thickness of a fastening lug renders the lug prone to deformation failure caused by overtightening of the set-screw, particularly in applications where the legs of the top wall have been spot welded together or in applications where a larger diameter set screw is to be used (thus requiring testing at higher installation torques). An installer typically does not carry and/or use a torque wrench to tighten the set-screw of the fastening lug, and thus there may be a tendency to overtighten the screw, particularly in applications where the wall thickness of the lug has been reduced and overtightening of the screw is more readily accomplished (that is, the region at which the material begins to plastically deform is reached thus allowing further tightening without requiring a significant increase in installation torque.

Decreasing the wall thickness of the fastening lug also render the lug prone to thread failure, e.g., from stripping of the threads allowing loosening of the set-screw. In this regard, the decrease in the thickness of the material decreases the length of threads in each leg of the top wall. Decreasing the wall thickness from, for example, 0.080" to 0.040" also decreases by 50% the total length of threads through the legs of the top wall. As mentioned above, a lug having a wall thickness of 0.080" already has a limited number of complete threads. Thus, the prior art has been unable to reduce the wall thickness of the fastening lug, and still provide a lug capable of meeting and/or exceeding the test requirements of the applicable electrical codes.

It has been discovered herein that the wall thickness of a fastening lug may be reduced by the incorporation of a torque limiting feature in the fastening lug. This torque limiting feature applies a braking torque to the set-screw so that the installer is provided with a positive feedback of screw tightness without a corresponding amount of force being applied to the wire conductor and housing. Stated differently, an installation torque $T_I$ (e.g., 15 to 20 in-lb) may be applied to the set-screw by the installer, while the actual torque experienced by the set-screw below thread plane L of the top wall is only $T_A$, wherein $T_A$ is less than $T_I$. Inasmuch as $T_A$ is less than $T_I$, the tensile preload force in the set-screw below thread plane L will be less than the tensile force experienced in a prior art fastening lug, that is, one without the torque limiting feature described herein.

Figure 7A:
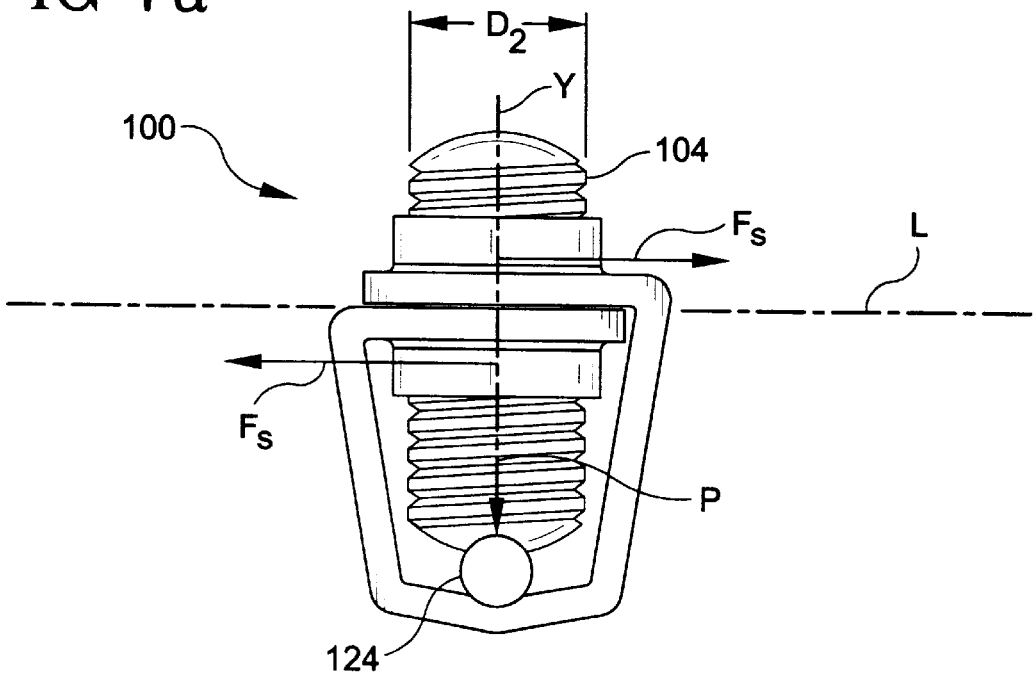
FIG. 7*a* is an elevational view of the grounding lug of the present invention showing the application of shear forces $F_S$ to the top wall of the housing.

Referring to FIG. 7*a*, set-screw 104 of the present invention is advanced until it contacts conductor 124. In this regard, this screw is tightened by the application of an installation torque $T_I$ thereto (see FIG. 7*b*). This introduces a tensile preload force P into the structure which acts in the direction of axis Y. As discussed herein, force P introduces stresses into the housing of the lug that produce shear forces $F_S$ which act in the direction of thread plane L. As shown, set screw 104 has a diameter $D_2$.

For simplification, the torque-preload relationship for a bolt fastened joint may be defined as follows:

$$T=kDP$$

wherein T=installation torque;
k=nut friction factor (0.08 to 1.0);
D=bolt mean diameter; and
P=tensile preload force.

It will be recognized that P is a linear function of T. It will be further seen that as the installation torque is increased, the tensile preload force P imparted on the grounding conductor (and thus on the housing itself) is increased.

To prevent over-tightening of the set-screw and thus destruction of the lug, the present invention utilizes a unique combination of features to create a braking torque (referred to herein as a parasitic torque S) which is a function of the installation torque and which acts upon the set-screw in a rotational direction opposite to that of the installation torque. This relationship is defined as follows:

$$T=KDP-S$$

wherein S=the parasitic torque due to thread shear and S=f(T).

As a result, the parasitic torque counteracts the installation torque at thread plane L whereby the actual torque $T_A$ in the set-screw below the thread plane L is less than the installation torque $T_I$.

In use, the installer tightens the set screw by applying an installation torque of, for example, 15 in-lb, which according to the equation set forth above, would produce a tensile preload force $P_1$. The fastening lug of the present invention produces a parasitic torque S at the thread plane L which acts in opposite direction to installation torque $T_I$, thereby functioning as a partial torsional brake against the set-screw whereby the actual torque $T_A$ in the set-screw below the thread plane is less than the installation torque $T_I$. As a result, the installer is satisfied the set screw is sufficiently tightened and, at the same time, a preload force of only $P_2$ is introduced into the structure, wherein $P_2$ is less than $P_1$.

Figure 7B:
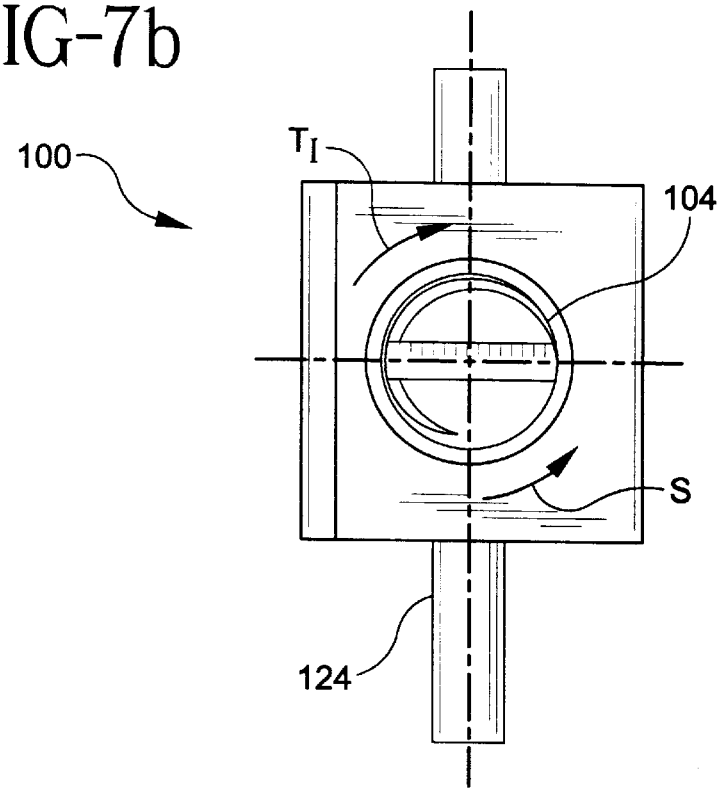
FIG. 7*b* is a top view of the grounding lug of FIG. 7*a* showing the directions of torque $T_I$ and parasitic torque S.

As will be discussed in more detail hereinbelow, tensile preload force P introduces a stress into the housing of the lug which produces transverse shear forces $F_S$ acting in the directions indicated by arrows $F_S$ in FIG. 7*a*. These forces act in opposite directions, applying equal and opposite forces to set screw 102. Referring to FIG. 7*b*, it will be appreciated that the application of opposing forces $F_S$ on set screw 104 produces a braking torque equal to $(F_2)(D_2)(k)$, which is referred to herein as parasitic torque S.

Figure 8A:
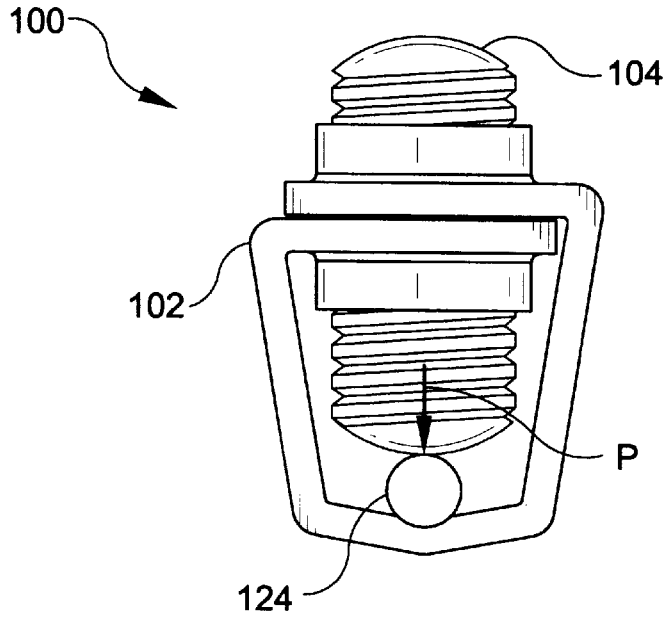
FIGS. 8*a*–8*b* are elevational views of the grounding lug of the present invention depicting shear forces $F_S$.
Figure 8B:
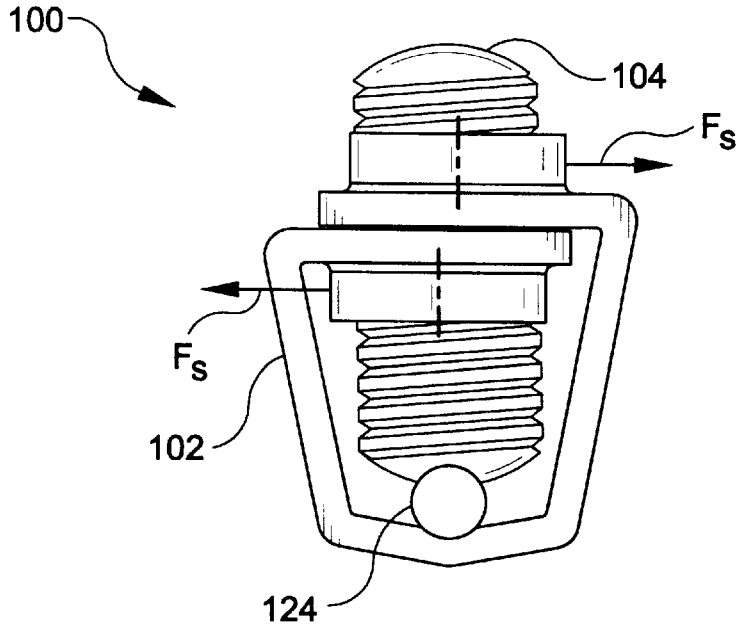

For ease of understanding, the torsional interference which acts upon the set screw 104 upon tightening of set screw against conductor 124 is shown in FIGS. 8*a*–8*b*. More particularly, FIG. 8*a* depicts the set-screw at the point where it begins to make contact with conductor 124 and wherein P=0. FIG. 8*b* depicts the housing of the fastening lug after the set-screw has been tightened against the grounding conductor. The introduction of stress into housing 102 creates shear forces $F_S$ which act against the screw thus applying a torsional interference on such screw. This torsional interference is depicted in exaggerated detail in FIG. 8*b* and is indicted by the misalignment of the center lines of the upper and lower passages of the legs of the top wall.

It has been discovered herein that a parasitic torque can be introduced into the structure of a fastening lug and can be used to limit or otherwise brake the application of an installation torque to a set-screw. The creation of this parasitic torque involves the design of several criteria including 1) the shape, overall thickness and material of the housing, 2) the fabrication of the housing, and 3) the fabrication of the threaded passages which receive the set screw. The present invention therefore contemplates and is intended to encompass any combination of the above-identified criteria which together provide a fastening lug that produces a parasitic torque upon clamping of a body portion therein, such parasitic torque acting in opposite directions of the installation torque to limit/brake the installation torque.

Figure 9B:
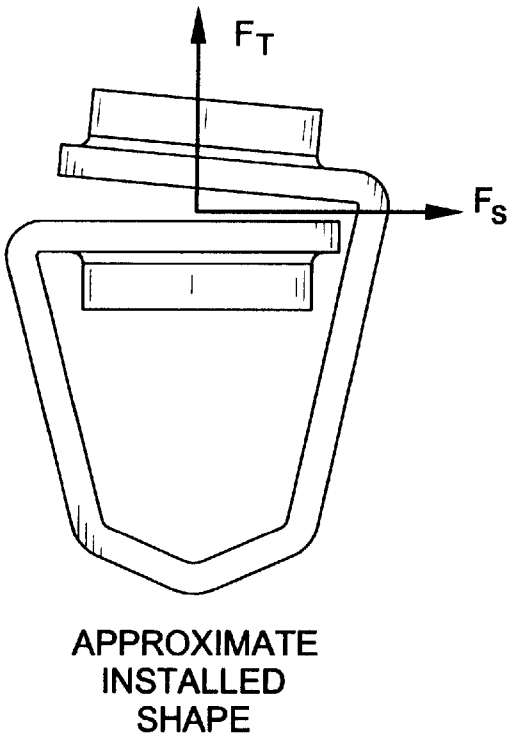
FIGS. 9*a*–9*f* are computer generated drawings resulting from a finite element analysis of the lug of the present invention subjected to enforced displacement in the Y direction.
Figure 9A:
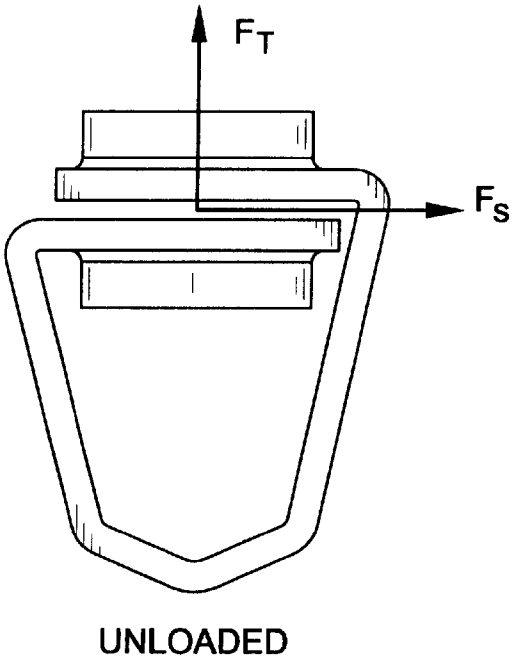
Figure 9D:
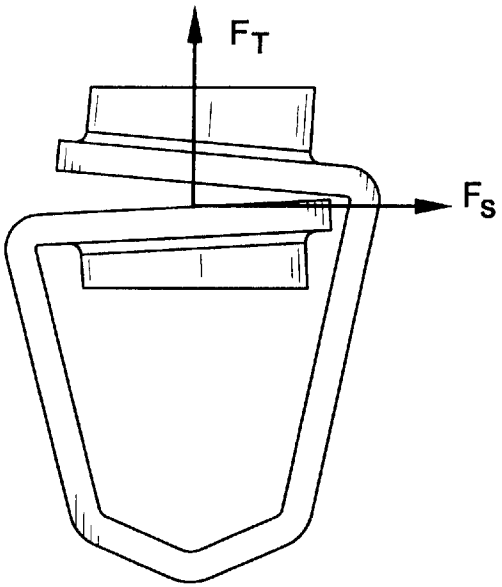
Figure 9C:
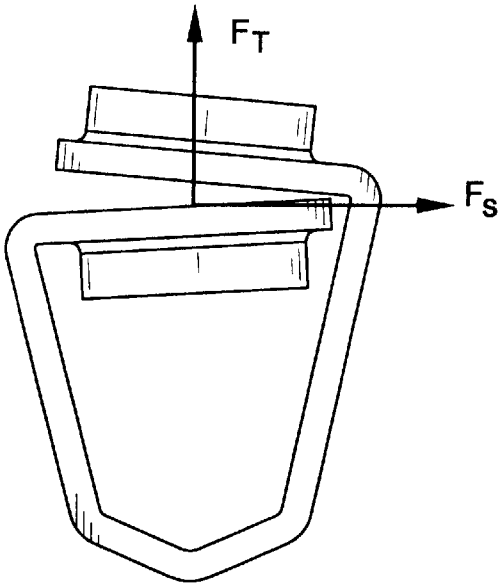
Figure 9E:
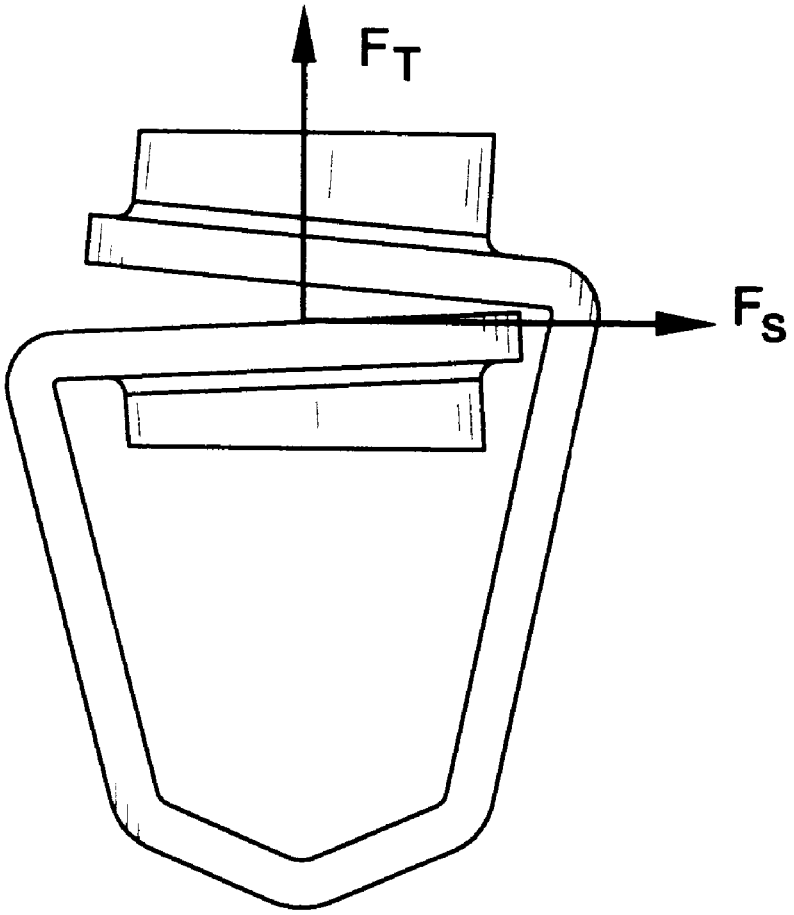
Figure 9F:
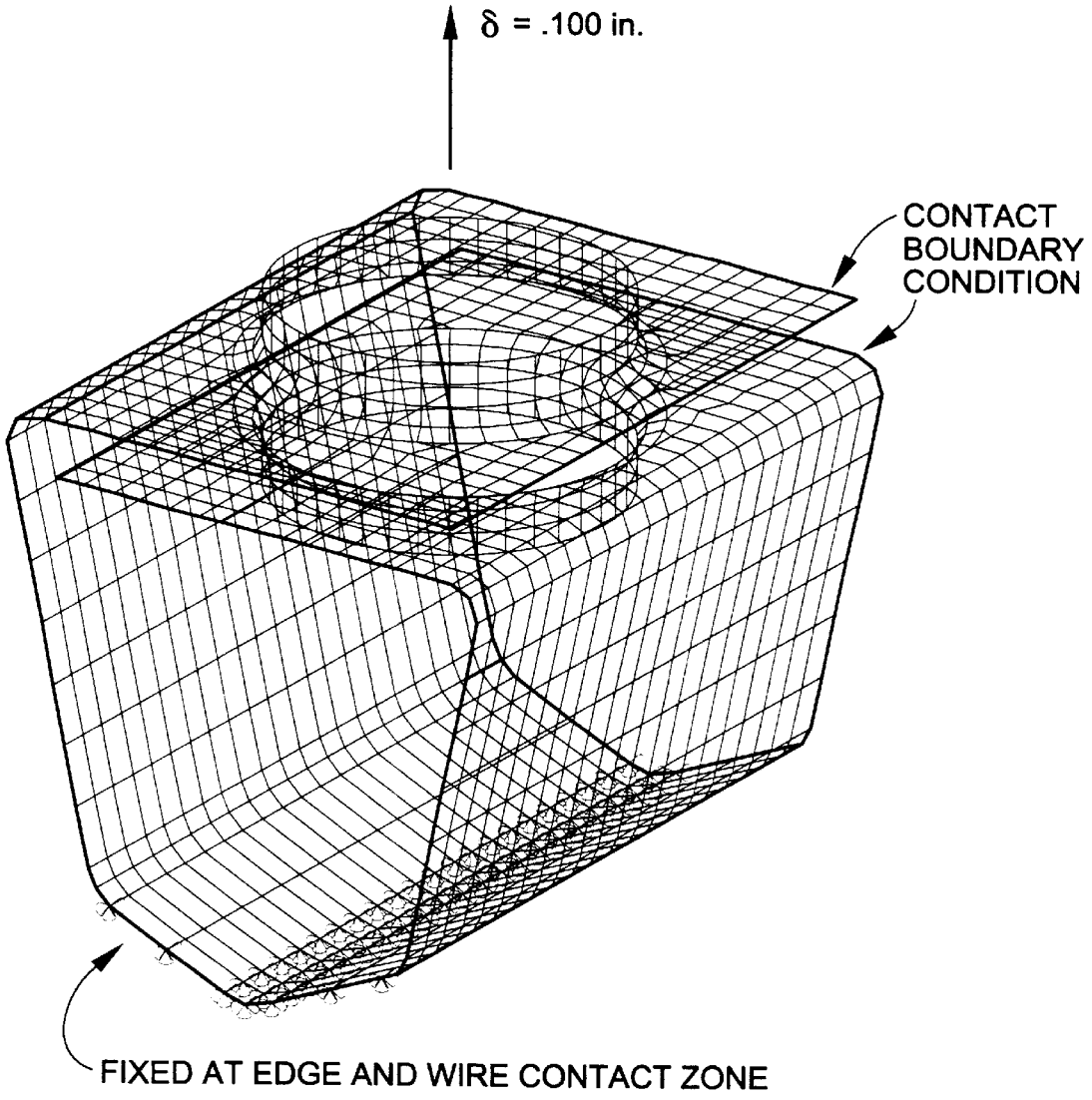

Referring now to FIGS. 9*a*–9*e*, the controlled deformation of the housing of the present fastening lug is shown. FIGS. 9*a* to 9*e* are the result of a finite element (FE) model of the lug of the present invention using MSC/PATRAN and analyzed using MSC/ABAQUS. The lug was considered to be restrained at the lower rear edge and at the wire-to-lug interface (see FIG. 9*f*). The lug was loaded by applying an enforced displacement to the upper and lower threaded protrusions in the Y direction. The contact boundary condition between the threaded protrusions was also included with a static coefficient of friction (k=4), a typical conservative value. FIG. 9*a* illustrates the initial starting point of the structure wherein $\delta_Y=0$, P=0 and $F_S=0$. FIG. 9*b* illustrates the controlled deformation of the housing which occurs upon the displacement in the Y direction of 0.0136 inches. At this point, P=345 pounds and $F_S=102$ pounds. The controlled deformation illustrated in FIG. 9*b* represents the approximate deformation which results in the lug of the present invention upon application of an installation torque of approximately 25 in-lbs (which represents a maximum test condition). FIGS. 9*c* to 9*e* illustrate the continued deformation of the lug through further enforced displacement. More particularly, FIG. 9*c* illustrates a displacement in the Y direction of 0.029 inches, FIG. 9*d* illustrates a displacement in the Y direction of 0.037 inches and FIG. 9*e* represents a displacement in the Y direction of 0.043 inches. The lug illustrated in FIG. 9*e* would likely be considered destroyed upon a visual inspection thereof FIG. 9*f* is a three dimensional representation of the finite element model showing that portion of the model which was restrained. As noted, this model considered the interaction of the upper and lower legs of the top wall.

FIG. 10 graphically illustrates the relationship between tensile preload load force P and deformation δ. The lower curve represents the shear force $F_S$ introduced into the structure. As seen, the shear force $F_S$ increases rapidly with the tensile force P, but then levels off at a force of approximately 100 lb. As will be recognized by those skilled in the art, this leveling off represents the point at which the material begins to undergo plastic deformation. The upper curve represents the tensile force P introduced into the structure. As shown, the tensile force P builds rapidly to approximately 320–360 lb, after which the force levels off to approximately 375 lb once the material begins to undergo plastic deformation, and thereafter again begins to increase when the lug deformation reaches approximately 0.06 inches. When an installation testing torque $T_I$ of 25 in-lb is applied to the preferred set-screw of the present invention formed from 0.040" thick tin-plated brass, the tensile force in the lug is 333 lb using a set-screw diameter of 0.25" and a coefficient of friction of 0.3:

$$P=T/kD=25/(0.3)\ (0.25)=333\ \text{lb}.$$

A tensile force of 333 lb corresponds to point E on curve P. It will be seen that point E is outside the region of plastic deformation, the onset of which begins at approximately point G on curve P. As shown, point E on curve P corresponds to point H on curve $F_S$, that is both points represent a deformation of approximately 0.0136" (see FIG. 9*b*). Point H of curve $F_S$ has a vertical force component of approximately 100 lb. Thus, at an $F_S$ of 100 lb, a set screw diameter of 0.25" and a coefficient of friction of 0.3, parasitic torque S=(100) (0.25) (0.3)=7.5 in-lb.

Figure 11:
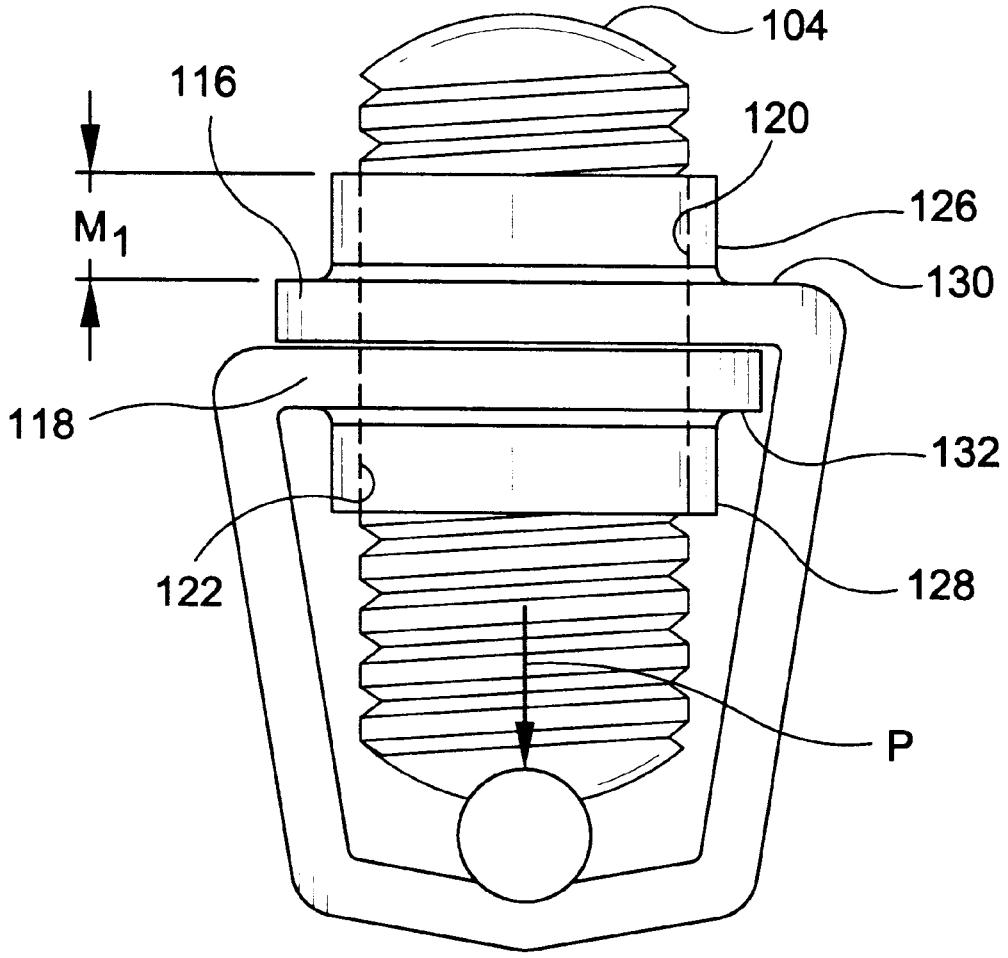
FIG. 11 is an elevational view of the grounding lug of the present invention.

As will be recognized by those skilled in the art, the strength of most materials is greater in compression than in tension. Referring to FIG. 11, lug 100 is formed with collars 126, 128, collar 126 being formed as part of upper leg 116, and collar 128 being formed as part lower leg 118. Thus, collar 126 is extruded upward from surface 130 of upper leg 116 a distance $M_1$ (wherein $M_1$ is approximately 0.075"), while collar 128 is also extruded downward from surface 132 of lower leg 118 a distance $M_1$ (wherein $M_1$ is approximately 0.075"). Thus, each threaded passage includes at least as many threads as the threaded passage of prior art lug 50 formed from material having twice the wall thickness. As the screw is tightened against the wire, the screw applies a force P on the wire. This force P, which is also experienced by the screws, acts against collar 128 of lower leg 118, applying a compressive force to threads of passage 122 (i.e., the force acts against the direction of extrusion). The threads of passage 122 are thus capable of accepting greater forces without stripping, as compared to prior art lugs. The force acting against lower leg 118 causes the leg to begin to cam open. The collar attached to upper leg 116 accepts the load of camming, applying a compressive force to the threads of passage 120. Again, the threads of passage 120 are capable of accepting greater forces without stripping.

Figure 12A:
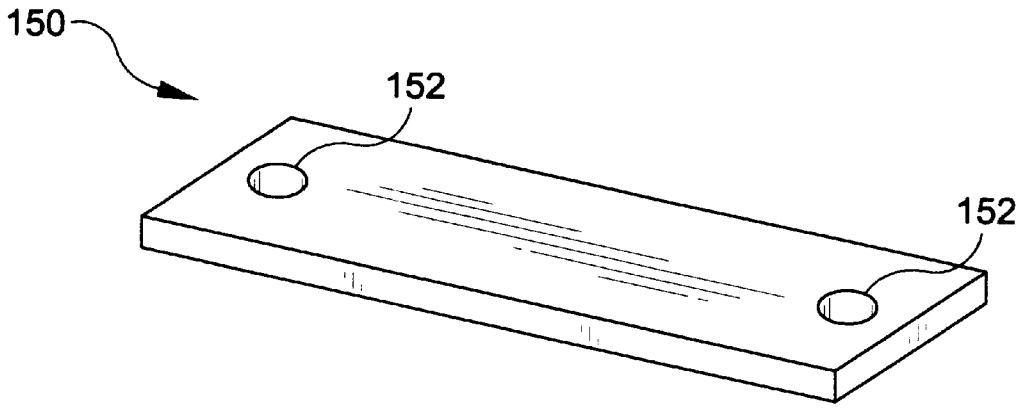
FIGS. 12*a*–12*d* are views showing the manufacturing steps involved in the fabrication of the grounding lug of the present invention.
Figure 12B:
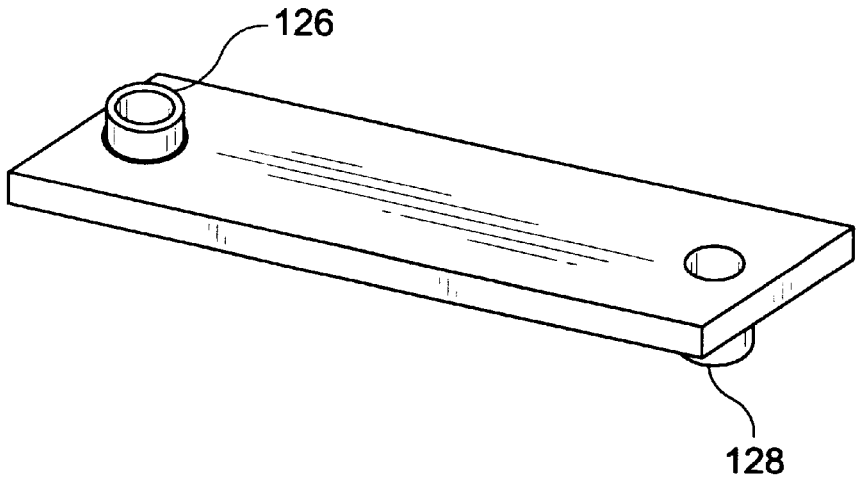
Figure 12C:
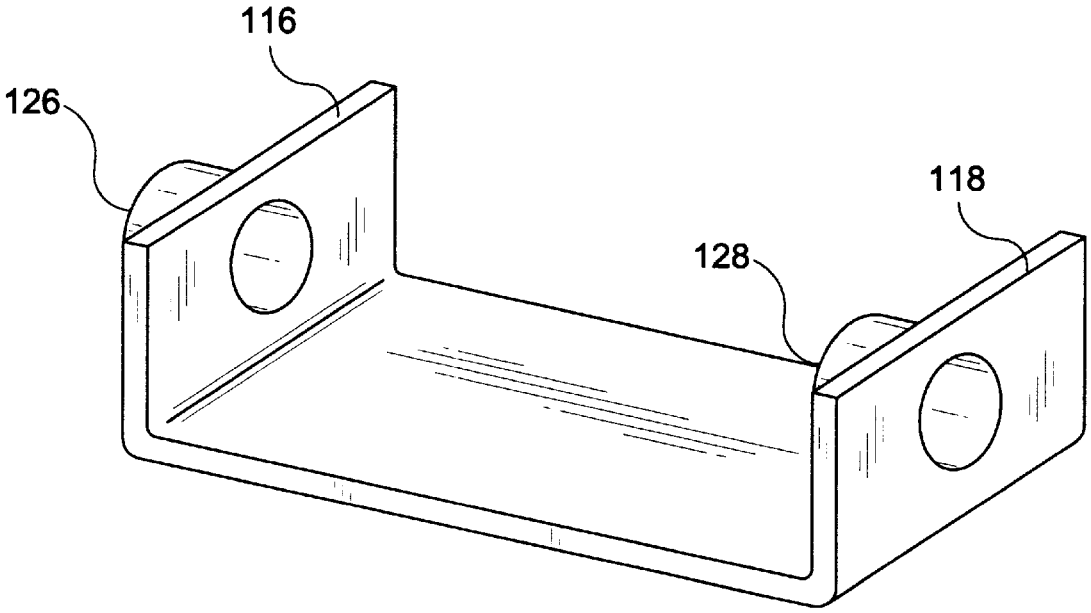
Figure 12D:
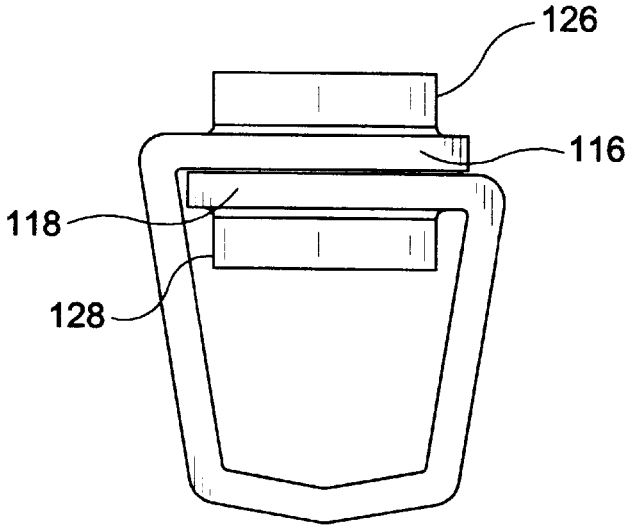

Lug 100 is preferably formed from a strip 150 of sheet stock (e.g., tin-plated brass having a wall thickness of 0.040 inches), as shown in FIG. 12*a*. Holes 152 are formed in strip 150. Holes 152 are then extruded to form collars 126, 128 of equal diameter as shown in FIG. 12*b*. The collars are formed on opposing sides of the strips. This technique is commonly referred to as "piercing and extruding." These collars, which define passages 120, 122 are subsequently threaded, preferably with similarly sized threads. This technique provides the additional benefit that the resultant threads are work-hardened. Referring to FIG. 12*c*, the opposing sides of the strip are thereafter bent to form upper and lower legs 116, 118, respectively. Finally, this strip is bent into the preferred configuration of FIG. 12*d*, resulting in the collar of upper leg 116 being positioned on its exterior surface, and the collar of lower leg 118 being positioned on its interior surface.

What is claimed is:

1. A fastening lug, comprising:

a housing defined by at least top, bottom and side walls;

a fastener cooperating with said top wall and advancable between a first position wherein a portion of a body is positioned in said housing and a second position wherein said portion is pressed between said bottom wall and said fastener whereby said portion is retained within said housing; and wherein said top wall includes upper and lower legs, said upper leg being integrally formed with one of said side walls and said lower leg being integrally formed with the other of said side walls, and wherein each of said legs includes an extruded threaded collar located on a surface thereof, each of said collars defining a direction of extrusion and being located such that the threads of said collars are subjected to compressive forces which act in a direction generally opposite to said direction of extrusion thereby tending to compress each of said collars with respect to its associated leg when said fastener is advanced to said second position.

2. The lug according to claim 1, wherein said collars are located on an outer surface of said upper leg and on an inner surface of said lower leg.

3. The lug according to claim 1, wherein said collars define passages for advancement of said fastener therethrough, and wherein said passages are axially misaligned whereby alignment of said passages for insertion of said fastener imparts vibration-resistant shear forces on said fastener passages which resist back-out of said fastener when said housing is subjected to vibration.

4. The lug according to claim 1, wherein said fastener is configured to introduce a stress into said housing when said fastener is moved to said second tightened position, and wherein said housing is configured to allow said stress to produce transverse shear forces along said top wall which act against said fastener, said shear forces developing a parasitic torque opposite in direction to an installation torque wherein the relationship of forces is defined by the equation:

$$T=KDP-S\ \text{wherein}$$

T=installation torque;

k=nut friction factor (0.08 to 1.0);

D=bolt mean diameter;

P=tensile preload force; and

S=the parasitic torque due to thread shear and S=f(T).

5. A method of forming a lug, comprising:

providing a strip of material;

piercing a first hole through a first side of said strip and a second hole through a second side of said strip;

extruding each of said holes to form first and second collars positioned on said first and second sides of said strip, respectively;

threading each of said collars;

forming said housing, said forming step including the step of bending said strip to substantially align said collars to allow a set-screw to be threadingly engaged with both of said threaded collars, said bending step including the further step of locating said threaded collars with respect to said housing as to subject the threads of said collars to compressive forces which tend to compress each of said collars with respect to its associated leg when a body is fixedly secured within said housing.

6. The method according to claim 5, wherein said bending step includes the step of misaligning said threaded collars whereby a vibration-resisting force is imparted on said set-screw upon threading engagement of said set screw with both of said threaded collars.

7. The method according to claim 6, comprising the further step of forming at least a portion of said strip into an arm, said arm being adapted for subsequent securement to a cooperating member.

8. The method according to claim 7, comprising the further step of forming at least a portion of said strip into a support base adapted to cooperate with said member.

9. The method according to claim 6, wherein said bending step includes the further step of forming a channel in a bottom wall of said housing to facilitate clamping of a body therein.

10. A vibration-tolerant fastening lug assembly, comprising:

a housing defined by at least top, bottom and side walls;

a fastener cooperating with said top wall and advancable between a first position wherein a portion of a body is positioned in said housing and a second position wherein said portion is pressed between said bottom wall and said fastener whereby said portion is retained within said housing; and wherein said top wall includes two legs, one of said legs being associated with one of said side walls and the other of said legs being associated with the other of said side walls, each of said legs having a threaded passage therethrough to allow advancement of said fastener into said housing, and wherein said passages are axially misaligned whereby alignment of said passage for insertion of said fastener imparts vibration-resistant shear forces on said fastener along said threaded passages which resist back-out of said fastener when said housing is subjected to vibration.

* * * * *

UNITED STATES PATENT AND TRADEMARK OFFICE

CERTIFICATE OF CORRECTION

PATENT NO. : 6,074,121
DATED : June 13, 2000
INVENTOR(S) : Jay C. Medeiros et al.

It is certified that error appears in the above-identified patent and that said Letters Patent is hereby corrected as shown below:

Column 8,
Line 4, "($F_2$)" should read -- (Fs) --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*